US009308720B2

(12) United States Patent
Van Sas

(10) Patent No.: US 9,308,720 B2
(45) Date of Patent: Apr. 12, 2016

(54) INK JET PRINTER AND PRINTING METHOD

(71) Applicant: Océ-Technologies B.V., Venlo (NL)

(72) Inventor: Lambertus M.L. Van Sas, Venlo (NL)

(73) Assignee: OCE-TECHNOLOGIES B.V., Venlo (NL)

( * ) Notice: Subject to any disclaimer, the term of this patent is extended or adjusted under 35 U.S.C. 154(b) by 0 days.

(21) Appl. No.: 14/704,610

(22) Filed: May 5, 2015

(65) Prior Publication Data

US 2015/0328882 A1 Nov. 19, 2015

(30) Foreign Application Priority Data

May 19, 2014 (EP) ..... 14168821

(51) Int. Cl.
*B41J 29/38* (2006.01)
*B41J 2/045* (2006.01)

(52) U.S. Cl.
CPC ..... *B41J 2/04541* (2013.01); *B41J 2/04581* (2013.01); *B41J 2/04586* (2013.01); *B41J 2/04588* (2013.01); *B41J 2/04598* (2013.01)

(58) Field of Classification Search
CPC .. B41J 2/04528; B41J 2/0458; B41J 2/04598; B41J 2/16526; B41J 2/04581; B41J 2/04588; B41J 2/04541; B41J 2/04593
USPC ..... 347/9–11, 14, 15, 17, 22, 23
See application file for complete search history.

(56) References Cited

U.S. PATENT DOCUMENTS

| | | | | |
|---|---|---|---|---|
| 4,982,199 | A * | 1/1991 | Dunn | H04N 1/40025 347/15 |
| 6,508,528 | B2 | 1/2003 | Fujii et al. | |
| 6,779,867 | B2 | 8/2004 | Shimizu et al. | |
| 8,272,708 | B2 * | 9/2012 | Silverbrook | B41J 2/1404 347/14 |
| 2002/0005873 | A1 * | 1/2002 | Suzuki | B41J 2/16526 347/27 |
| 2003/0081045 | A1 * | 5/2003 | Shimizu | B41J 2/16526 347/23 |
| 2004/0250727 | A1 * | 12/2004 | Jones | C09D 11/38 106/31.43 |
| 2006/0132534 | A1 * | 6/2006 | Ahne | B41J 2/165 347/32 |
| 2007/0146411 | A1 | 6/2007 | Robertson et al. | |

* cited by examiner

*Primary Examiner* — Alessandro Amari
*Assistant Examiner* — Yaovi Ameh
(74) *Attorney, Agent, or Firm* — Birch, Stewart, Kolasch & Birch, LLP

(57) ABSTRACT

An ink jet printer has a number of ink discharge nozzles, a number of actuators respectively associated with the nozzles and arranged to create pressure waves in the ink to be discharged from the respective nozzles, and a controller arranged to apply drive signals to the actuators in accordance with print instructions for an image to be printed. The drive signals include print pulses causing ink droplets to be ejected from the nozzles at timings when the respective nozzle faces an image part of a print medium, and spitting pulses causing ink droplets to be ejected from the nozzles at timings when the respective nozzle faces a non-image part of the print medium. The drive signals further include pre-fire pulses which have an amplitude below a threshold at which ink droplets are ejected, and the controller is arranged to apply the spitting pulses in the form of combined pulse sequences that each include a number of pre-fire pulses preceding the spitting pulse.

5 Claims, 2 Drawing Sheets

INK JET PRINTER AND PRINTING METHOD

The invention relates to an ink jet printer having a number of ink discharge nozzles, a number of actuators respectively associated with the nozzles and arranged to create pressure waves in the ink to be discharged from the respective nozzles, and a controller arranged to apply drive signals to the actuators in accordance with print instructions for an image to be printed, wherein the drive signals comprise print pulses causing ink droplets to be ejected from the nozzles at timings when the respective nozzle faces an image part of a print medium, and spitting pulses causing ink droplets to be ejected from the nozzles at timings when the respective nozzle faces a non-image part of the print medium.

BACKGROUND OF THE INVENTION

A printer of this type has been described in U.S. Pat. No. 6,779,867 B2.

The purpose of the spitting pulses is to prevent nozzle failures or nozzle malfunction that might be caused when the ink tends to dry out in the nozzle orifice while the nozzles are not used for a certain time. For each nozzle, the spitting pulses are timed such that another ink droplet is ejected before the ink has had time enough to dry out to such an extent that solidified ink sticks firmly to the wall of the nozzle orifice. Then, the droplet being ejected will remove the dried ink and clear the nozzle orifice again.

Spitting pulses may have to be applied regularly and hence, they may have to be applied onto the print medium at regular intervals. Because the spitting pulses may have to be applied at regular intervals, the resulting spit-droplets may have to be applied without taking into account the image to be printed. Therefore, spit-droplets may be applied onto a position of the recording medium which, pursuant to the print instructions, should not receive any ink. Although the individual ink dots are relatively small and spitting is controlled such that isolated drops will be distributed quasi-randomly over the media sheet, frequent spitting may degrade the quality of the printed image.

If the image is printed using a plurality of colors, spitting may result in droplets of the "wrong color" being applied onto the print medium. For example, when a yellow area is printed pursuant to print instructions, then a black spitted droplet spitted in that yellow area may decrease the print quality.

U.S. Pat. No. 6,508,528 B2 proposes an alternative approach for coping with the problem of ink drying out in the nozzle orifices. Instead of actually spitting ink droplets onto the recording medium, the actuators are exited by so-called pre-fire pulses the amplitude of which is kept so small that the meniscus of the liquid ink is only vibrated in the nozzle orifice but no droplets are formed and ejected. The vibrations induced in the liquid ink have the purpose to remove or dissolve the dry ink that would otherwise adhere to the walls of the nozzle orifices. However, in order to be effective, it is necessary to apply several hundreds or several thousands of pre-fire pulses to each nozzle before this nozzle is used again for printing. The large number of pre-fire pulses therefore implies an increased heat dissipation and energy consumption and may also reduce the life time of the actuators.

It is an object of the invention to provide an ink jet printer which can achieve an improved print quality without increased energy consumption or accelerated ageing of the print head.

SUMMARY OF THE INVENTION

In order to achieve this object, the invention provides an ink jet printer of the type specified in the opening paragraph, wherein the drive signals further comprise pre-fire pulses which have an amplitude below a threshold at which ink droplets are ejected, and the controller is arranged to apply the spitting pulses in the form of combined pulse sequences that each comprise a number of pre-fire pulses preceding the spitting pulse.

It has been found that by combining a spitting pulse with a number (i.e. at least one) of preceding pre-fire pulses, the cleaning efficiency of spitting is improved significantly. As a result, less spitting pulses are necessary and therefore, the time intervals between the spitting operations of an individual nozzle can be extended. Hence, less spits are required per printed page and consequently, the print quality is improved. Moreover, it has been found that this desirable effect can be achieved even when the number of pre-fire pulses that precede each spitting pulse is significantly smaller than the number of pre-fire pulses that has heretofore been applied to the nozzles prior to an actual print pulse in order to "prepare" the nozzle for a desired print operation. Consequently, the improved print quality can be achieved with an economic use of pre-fire pulses.

When printing, droplets of ink are ejected onto a recording medium, such as a sheet of paper, by applying pulses to the actuators of an inkjet print head, thereby expelling droplets of ink according to a predetermined pattern. This may result in the formation of a predetermined image onto the recording medium. When expelling droplets to form the predetermined image, print pulses may be applied to the actuator, thereby expelling image forming droplets.

Print heads typically comprise a plurality of nozzles. Depending on the image to be printed, some nozzles may be inactive for a longer period of time. In an inactive nozzle, nozzle clogging may occur, which may result in unstable jetting behaviour of the respective nozzle. To prevent such unstable jetting behaviour, ink may be ejected from the nozzles, even though such droplet may not be part of the predetermined pattern of droplets forming the predetermined image. In such case, ink may be ejected from the nozzle by applying a spitting pulse to the actuator. The spit droplets may be applied in addition to the droplets forming the pre-determined image. Applying the spitting pulse may result in the ejection of a spit droplet. Preferably, the volume of the spit droplet is smaller than the volume of the image forming droplet. Accordingly, the shape, amplitude and duration of the spitting pulse may be different from the shape, amplitude and duration of the printing pulse.

More specific optional feature of the invention are indicated in the dependent claims.

In a preferred embodiment, additional pre-fire pulses are applied to the nozzles immediately before a print process for a new media sheet starts. Typically, when media sheets are printed one after the other, the individual sheets are separated by certain gaps which translate into time gaps in which the nozzles of the printer must not fire. These time gaps can be utilized for pre-fire pulses. Thanks to the pre-fire pulses that are combined with the spitting pulses, a small number of pre-fire pulses in the time gap is sufficient for preparing the nozzles for printing and/or for keeping the nozzles functional during the time gap in which they cannot be used for printing.

BRIEF DESCRIPTION OF THE DRAWINGS

An embodiment example will now be described in conjunction with the drawings, wherein.

DETAILED DESCRIPTION OF THE DRAWINGS

Figure 1:
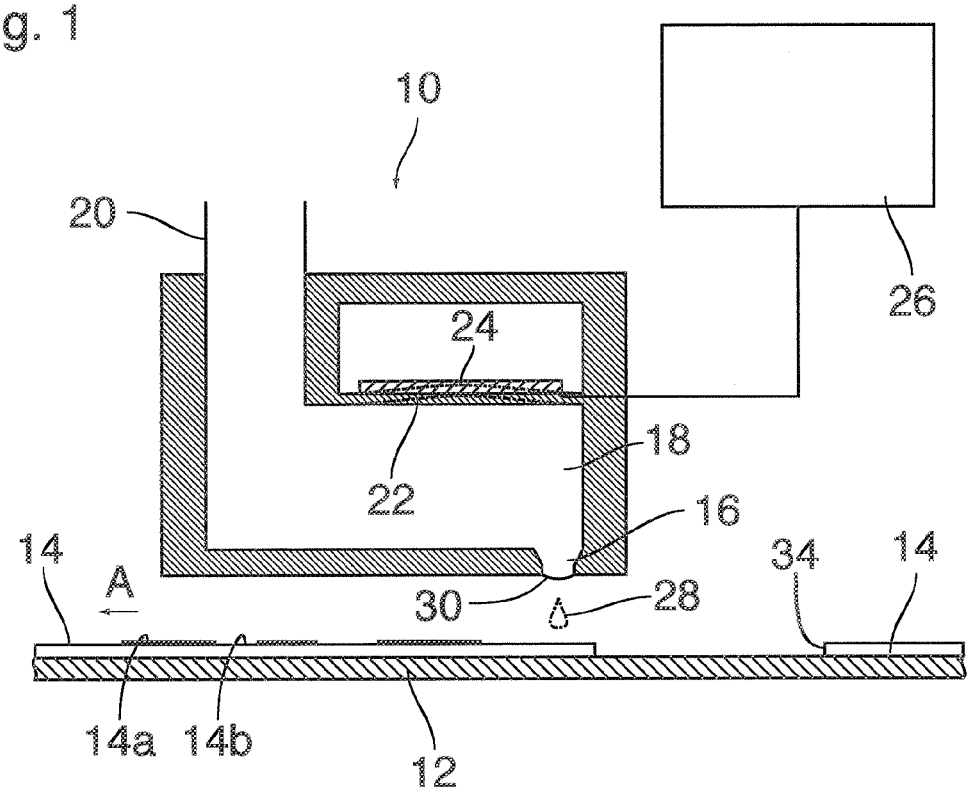
FIG. 1 is a schematic view of essential parts of an ink jet printer according to the invention.

The printer shown in FIG. 1 has a print head 10 disposed above a conveyer 12 (symbolized here by a portion of a conveyer belt) on which media sheets 14 are supplied and moved past the print head one after the other in direction of an arrow A. The print head 10 has an array of nozzles 16 only one of which has been shown in cross-section in the drawing. The nozzles 16 are formed in a bottom surface of the print head 10 facing the substrates 14 and are connected to respective pressure chambers 18 that are formed inside the print head 10.

An ink duct 20 connects the pressure chamber 18 to an ink reservoir (not shown), so that liquid ink can be supplied from the ink reservoir to the print head so as to fill the pressure chambers 18 associated with the nozzles 16.

Each pressure chamber 18 is delimited on the top side by a flexible wall or membrane 22 to which a piezoelectric actuator 24 is attached on the top side.

An electronic controller 26 is provided for individually driving each of the actuators 24. When an electric voltage is applied to the actuator 24, this causes the actuator to deform in a bending mode, so that the flexible membrane 22 is deflected accordingly, as has been symbolized by dot-dashed lines in FIG. 1. More specifically, when a voltage pulse is applied to the actuator 24, the rising flank of this pulse will cause the actuator 24 to bulge upwardly and to increase the volume of the pressure chamber 22 so that additional ink is sucked-in from the ink duct 20. Then, the falling flank of the pulse will cause the actuator to return to its original shape, so that a positive pressure wave is created in the liquid in the pressure chamber 18. This pressure wave propagates to the nozzle 16, and if the amplitude is large enough, an ink droplet 28 is ejected onto the media sheet 14, so that an ink dot will be formed. By controlling the shape, amplitude and the duration of the pulse, the movement of the fluid can be controlled. For example, it can be controlled whether a droplet of ink is ejected through the nozzle 16 or it can be controlled that the meniscus of the fluid in the nozzle is vibrated without expelling a droplet (pre-fire pulse). Hence, operation of the print head 10 can be controlled by controlling the operation of the actuator 24. Therefore, by controlling the times at which the actuators 24 are energized and the nozzles 16 are fired, it is possible to control the print head to print an image of predetermined color and shape on the media sheet 14 by controlling the ejection of droplets. Thus, as shown in FIG. 1, a printed sheet 14 has image parts 14*a* where ink dots have been applied, and non-image parts 14*b* where an unstained white background of the sheet should be visible. In addition, the stable operation of the print head 10 may be controlled by controlling the actuator 24 to timely apply a spitting pulse, such as a spitting pulse that comprise one or more pre-fire pulses preceding a spitting pulse.

As long as the actuator 24 is not active, the surface tension of a meniscus 30 of the liquid ink in the orifice of the nozzle 16 prevents the ink from leaking out of the pressure chamber 18.

Figure 2:
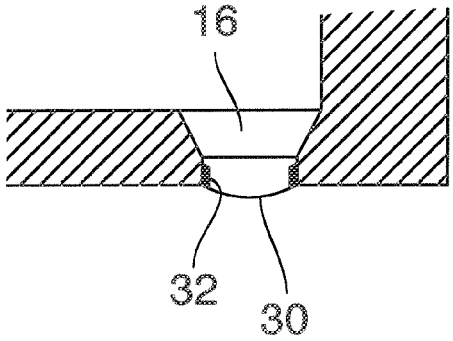
FIG. 2 is an enlarged detail of FIG. 1.

When a water-based ink or an ink based on an organic solvent is used, and an actuator 24 for an individual nozzle 16 is not activated during a certain period of time which may have a length of 0.1 s to 10 s, for example, depending on the type of ink, the solvent of the ink in the nozzle orifice will start to evaporate, and solid particles present in the ink, such as pigments and/or latex particles start to be deposited at the walls of the nozzle orifice and form a crust 32, as has been shown in FIG. 2. This crust of dried ink may change the volume of the ink droplet 28 and/or the direction in which it is expelled and will therefore degrade the print quality. When the ink continues to dry out, the nozzle 16 may eventually become clogged completely.

In the example shown in FIG. 1, the media sheets 14 are separated by a certain gap 34. In the time interval in which such a gap 34 moves through below the nozzle 16, the nozzle must not be fired because otherwise the ink would stain the surface of the conveyer 12. In order to prevent the ink in the nozzle orifices from drying out during this time interval, the controller 26 is arranged to apply a sequence of so-called pre-fire pulses to the actuators 24. These pulses have a low amplitude, i.e. a lower voltage than the normal print pulses that are applied when a droplet 28 is to be expelled. The amplitude is selected such that, although no droplets are ejected, the meniscus of the ink in the nozzle is vibrated. This has the effect that, when the solvent evaporates and the concentration of solid particles, such as pigment and/or latex particles in the ink in the nozzle 16 increases, the vibrating movement of the liquid will cause at least a part of the pigments to be flushed back into the interior of the pressure chamber 18 rather than forming the crust 32. Moreover, even when dried ink has deposited on the wall of the nozzle 16, the vibration may be strong enough to detach and remove the at least part of the deposits, so that the nozzle remains ready to operate for a prolonged period of time.

When the next media sheet 14 has reached the position below the nozzle 16, the actuator 24 may be energized with the normal amplitude so as to eject a droplet 28 when a pixel of an image part 14*a* is to be printed. However, depending upon the image to be printed and depending upon the position of the nozzle 16 in the array (in the direction normal to the plane of the drawing in FIG. 1), there may be cases where the nozzle is not needed for printing image pixels during a considerable time, so that there is again a risk of ink drying out.

In order to prevent this, the controller 26 is further arranged to drive the actuator 24 with so-called spitting pulses to spit a droplet of ink onto the recording medium. The spitting pulse may differ from the normal print pulse. Preferably, the spitting pulse may be configured to eject a droplet that has a smaller volume than a droplet ejected using the normal print pulse. Therefore, the volume of an ink droplet ejected using a spitting pulse (spit-droplet) is smaller than the volume of a droplet ejected using a normal print pulse (image forming droplet). Therefore, a spit-droplet 28 may be smaller than an image forming droplet, which even further reduces the visibility of the spit droplets in the image applied onto the recording medium 14. The volume of ink ejected by a pulse may be determined e.g. by the amplitude of the pulse, the duration of the pulse, the speed of the volume increase or decrease and the acoustic characteristics of the fluid chamber. When the time period in which no droplet has been ejected from the nozzle, the so-called open time, reaches a certain limit beyond which the risk of malfunction due to dried ink becomes significant, the controller 26 applies a spitting pulse to the pertinent actuator 24, so that a spit droplet 28 is "spit" onto the recording medium 14 even though, pursuant to the print instructions that define the printed image, no pixel should be formed at that position. For example, the nozzle may spit onto the white background in a non-image part 14*b* of the recording medium. In this way, the nozzle is kept operative by printing "unwanted" pixels.

As the size of an individual ink dot formed by a single droplet 28 is relatively small, at the limit of perceptibility, such spitting operations do not significantly degrade the print quality as long the frequency with which such spitting operations are performed is not too high.

However, when a spitting pulse has been applied and an ink droplet 28 has been spit onto the recording medium, a new crust 32 of dried ink will start to build up immediately, especially when the spitting operation has not cleaned the nozzle completely, so that a "seed" of dried ink has remained on the wall of the nozzle orifice. Consequently, the spitting operations have to be repeated in certain intervals if the nozzle is not needed for printing a regular image pixel in the meantime.

Figure 3:
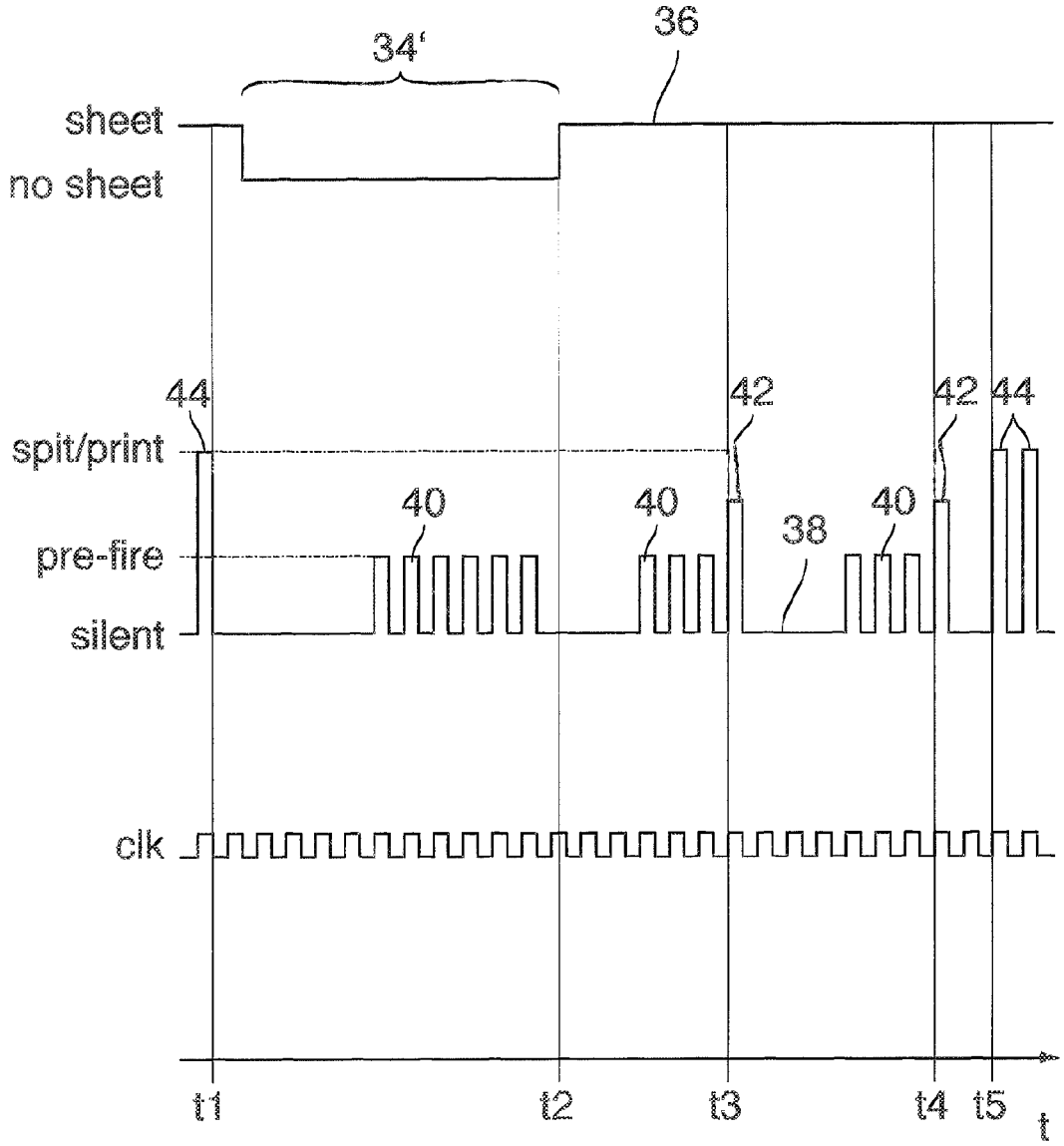
FIG. 3 is a diagram illustrating a printing method according to the invention.

According to the invention, the maximum time interval that is allowed between two spitting operations for one and the same nozzle 16 is increased by combining the spit pulse with a number of preceding pre-fire pulses, as has been illustrated in FIG. 3. By increasing the maximum time interval, less spit pulses are necessary per sheet of recording medium 14. Furthermore, when the maximum time interval is increased and less spits are necessary, there may be more possibilities to select a predetermined position on the sheet 14 to apply the spit droplet. The visibility of a spit droplet 28 may be decreased by "hiding" the spit droplet in the image to be printed. For example, if a yellow spit droplet is selected to be applied on a black area of the print, the spit droplet will hardly be observable by the human eye.

The curve 36 in the upper part of FIG. 3 designates, as a function of time t, the presence of media sheets 14 under the nozzle 16 in consideration. Thus, the time interval 34' in FIG. 3 corresponds to the time which the gap 34 between two sheets 14, shown in FIG. 1, needs to move past the nozzle.

A pulse train in the lower part of FIG. 3 shows, on the same time scale as the curve 36, the wave form of a drive signal 38 that the controller 26 applies to the actuator 24, i.e. the voltage applied to the actuator. As shown, the drive signal 38 comprises pre-fire pulses 40, spitting pulses 42 and print pulses 44. The spitting pulses 42 and the print pulses 44 have an equal amplitude, high enough to cause the ejection of ink droplets 28. In contrast, the pre-fire pulses 40 are configured not to eject a droplet of ink through a nozzle and have a lower amplitude below a threshold at which ink droplets would be ejected, but sufficient to vibrate the liquid ink in the nozzle orifice.

In the example shown, all pulses, i.e. the pre-fire pulses 40, the spitting pulses 42 and the print pulses 44 have the same duration and are synchronized with a common clock frequency symbolized by a curve clk in FIG. 3. This clock frequency corresponds to the frequency with which a nozzle is fired when a continuous line in the direction A in FIG. 1 is to be drawn while the media sheet 14 moves through below the nozzle. However, in an alternative embodiment the different pulses may have different durations.

In the time sequence illustrated in FIG. 3, a last print pulse 44 for printing an image pixel on a first sheet 14 has been applied at a time t1. Then, the nozzle must not fire for the duration of the time period 34', because no media sheet is below the nozzle. By the end of this time period 34', however, a sequence of pre-fire pulses 40 is applied for keeping the nozzle open and/or regenerating the nozzle and thereby extending the nozzle open time.

At the time t2, a detector (not shown) detects that the leading edge of the next sheet 14 has reached the position of the nozzle. However, by analyzing the print instructions specifying the image to be printed, the controller 26 finds that the nozzle will not be needed for printing a pixel before the time t5. As the interval between t2 and t5 is larger than the admissible nozzle open time, the controller 26 schedules a suitable number (two in this example) of spitting pulses 42 to be applied to the nozzle at times t3 and t4.

However, rather than applying isolated spitting pulses as in the prior art, the controller 26 applies combined pulse sequences comprising the spitting pulse 42 as the last pulse and a number of preceding pre-fire pulses 40. While pulse sequences with only three pre-fire pulses have been shown in the drawing, the number of pre-fire pulses will be significantly larger in practise. For example, the pulse sequence may contain several tens or hundreds of pre-fire pulses.

Without wanting to be bound to any theory, it is believed that these pulses and the resulting vibration of the liquid ink in the nozzle orifice loosens the crust 32 even though the crust may not be removed completely. Nevertheless, the strength with which the crust adheres to the walls of the nozzle orifice is reduced to such an extent that the final spitting pulse 42 and the resulting ejection of the ink droplet 28 will remove the remnants of dried ink.

This strategy permits to reduce the number spitting pulses that are needed per nozzle and per sheet to be printed from, for example, 5 to 2. In other words, the permissible nozzle open time is extended.

Moreover, this extended nozzle open time permits to reduce the number of pre-fire pulses that have to be applied in the time interval 34' between two subsequent sheets, with the desirable effect that energy consumption and heat dissipation are reduced and the life time of the actuators 24 is extended.

The spitting pulses 42 and the pre-fire pulses 40 preceding them need not necessarily be synchronized with the clock signal for the print pulses 44. However, the spitting pulses 42 and the pre-fire pulses 40 preceding them should form a pulse sequence in the sense that there exists a predetermined time relationship between these pulses. In particular, there is a maximum value for the delay between the last pre-fire pulse 40 and the spitting pulse 42. Preferably, this delay should be shorter than the decay time of the acoustic vibrations that the pre-fire pulse 40 induces in the liquid ink.

Detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. In particular, features presented and described in separate dependent claims may be applied in combination and any advantageous combination of such claims are herewith disclosed.

Further, the terms and phrases used herein are not intended to be limiting; but rather, to provide an understandable description of the invention. The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. An ink jet printer, comprising:

a number of ink discharge nozzles;

a number of actuators respectively associated with the nozzles and arranged to create pressure waves in the ink to be discharged from the respective nozzles; and a controller arranged to apply drive signals to the actuators in accordance with print instructions for an image to be printed, wherein the drive signals comprise:

print pulses causing image forming droplets to be ejected from the nozzles at timings when the respective nozzle faces an image part of a print medium;

spitting pulses causing spit droplets to be ejected from the nozzles at timings when the respective nozzle faces a non-image part of the print medium; and pre-fire pulses which have an amplitude below a threshold at which ink droplets are ejected, and wherein the controller is arranged to apply the spitting pulses in the form of combined pulse sequences that each comprise a number of pre-fire pulses preceding the spitting pulse.

2. A printing method for printing with an ink jet printer that has a number of ink discharge nozzles, a number of actuators respectively associated with the nozzles and arranged to create pressure waves in the ink to be discharged from the respective nozzles, the method comprising the steps of:

applying drive signals to the actuators in accordance with print instructions for an image to be printed, wherein the drive signals comprise:

print pulses causing image forming droplets to be ejected from the nozzles at timings when the respective nozzle faces an image part of a print medium;

spitting pulses causing spit droplets to be ejected from the nozzles at timings when the respective nozzle faces a non-image part of the print medium; and pre-fire pulses which have an amplitude below a threshold at which ink droplets are ejected, wherein the spitting pulses are applied in the form of combined pulse sequences that each comprise a number of pre-fire pulses preceding the spitting pulse.

3. The method according to claim 2, wherein print media sheets are moved past the nozzles one after the other, with gaps being formed between successive sheets, and wherein additional pre-fire pulses are applied in a time period in which said gap moves past the nozzles.

4. The method according to claim 2, wherein the volume of a spit droplet is smaller than the volume of an image forming droplet.

5. A computer program product comprising program code on a non-transitory computer-readable medium, which program code, when executed on the controller of the ink jet printer as claimed in claim 1, causes the controller to perform a method for printing with an ink jet printer that has a number of ink discharge nozzles, a number of actuators respectively associated with the nozzles and arranged to create pressure waves in the ink to be discharged from the respective nozzles, the method comprising the steps of:

applying drive signals to the actuators in accordance with print instructions for an image to be printed, wherein the drive signals comprise:

print pulses causing image forming droplets to be ejected from the nozzles at timings when the respective nozzle faces an image part of a print medium;

spitting pulses causing spit droplets to be ejected from the nozzles at timings when the respective nozzle faces a non-image part of the print medium; and pre-fire pulses which have an amplitude below a threshold at which ink droplets are ejected, wherein the spitting pulses are applied in the form of combined pulse sequences that each comprise a number of pre-fire pulses preceding the spitting pulse.

* * * * *